US011302231B2

(12) United States Patent
Xue et al.

(10) Patent No.: US 11,302,231 B2
(45) Date of Patent: Apr. 12, 2022

(54) PIXEL DRIVING CIRCUIT AND DISPLAY PANEL

(71) Applicant: SHENZHEN CHINA STAR OPTOELECTRONICS SEMICONDUCTOR DISPLAY TECHNOLOGY CO., LTD., Shenzhen (CN)

(72) Inventors: Yan Xue, Shenzhen (CN); Baixiang Han, Shenzhen (CN)

(73) Assignee: SHENZHEN CHINA STAR OPTOELECTRONICS SEMICONDUCTOR DISPLAY TECHNOLOGY CO., LTD., Shenzhen (CN)

( * ) Notice: Subject to any disclaimer, the term of this patent is extended or adjusted under 35 U.S.C. 154(b) by 262 days.

(21) Appl. No.: 16/624,401

(22) PCT Filed: Dec. 10, 2019

(86) PCT No.: PCT/CN2019/124256

§ 371 (c)(1),
(2) Date: Dec. 19, 2019

(87) PCT Pub. No.: WO2021/082197

PCT Pub. Date: May 6, 2021

(65) Prior Publication Data

US 2021/0358368 A1 Nov. 18, 2021

(30) Foreign Application Priority Data

Oct. 29, 2019 (CN) ..... 201911034241.7

(51) Int. Cl.
*G09G 3/3225* (2016.01)
*G09G 3/20* (2006.01)

(52) U.S. Cl.
CPC ..... *G09G 3/20* (2013.01); *G09G 2300/043* (2013.01); *G09G 2300/0426* (2013.01); *G09G 2300/0819* (2013.01); *G09G 2300/0842* (2013.01); *G09G 2320/0233* (2013.01)

(58) Field of Classification Search
CPC ..... G09G 2300/0426; G09G 2300/043; G09G 2300/0819; G09G 2320/0233
See application file for complete search history.

(56) References Cited

U.S. PATENT DOCUMENTS

2017/0061871 A1* 3/2017 Xiang ..... G09G 3/3233

* cited by examiner

*Primary Examiner* — Dennis P Joseph
(74) *Attorney, Agent, or Firm* — Dickinson Wright PLLC

(57) ABSTRACT

A pixel driving circuit and a display panel provided by the present disclosure detect an actual voltage of an eighth transistor in each pixel, and determine a threshold voltage of the eighth transistor in each pixel according to the actual voltage, thereby effectively compensating the eighth transistor in each pixel to achieve the objective of improving luminous uniformity of light-emitting devices and display quality.

9 Claims, 3 Drawing Sheets

PIXEL DRIVING CIRCUIT AND DISPLAY PANEL

FIELD OF INVENTION

The present disclosure relates to the field of display technologies, and more particularly, to a pixel driving circuit and a display panel.

BACKGROUND OF INVENTION

In current technology, transistors in a pixel driving circuit generally use low temperature polysilicon thin film transistors or oxide thin film transistors. However, under a long time of applying voltages and high temperature, a threshold voltage of transistors will shift and cause to display different images, and due to different extents of threshold shifts of each thin film transistor in a panel, it will cause a difference of brightness when displaying. The difference relates to an image shown previously, therefore, an afterimage often appears.

Technical problem: the present disclosure mainly solves the technical problem of how to compensate threshold voltage changes of driving transistors, thereby improving luminous uniformity of light-emitting devices and display quality.

SUMMARY OF INVENTION

At a first aspect, an embodiment of the present disclosure provides a pixel driving circuit, which comprises a compensation module, a receiving module, a light-emitting module, and a detection module; wherein the receiving module and the detection module are connected to the light-emitting module, and the receiving module and the detection module are connected to the compensation module;

the compensation module receives a first voltage signal, a second voltage signal, a first clock signal, a second clock signal, a data signal, a scanning signal, and a first power supply signal, the compensation module is used to transmit the data signal to a first node under control of the first power supply signal; the compensation module receives a first voltage signal, a second voltage signal, a first clock signal, a second clock signal, a data signal, a scanning signal, and a first power supply signal, the compensation module is used to transmit the data signal to a first node under control of the first power supply signal;

the receiving module is electrically connected to a second node and the first node, and the receiving module is used to transmit the data signal to the second node under control of an electric potential of the first node;

the detection module receives a regulated signal, the detection module is used to transmit the regulated signal to a third node under control of the electric potential of the first node to stabilize an electric potential of the third node, and the detection module is also used to detect an actual voltage of the light-emitting module and to compare the actual voltage to a predetermined voltage in order to generate a compensation voltage of the light-emitting module;

wherein the compensation module is also used to compensate the data signal according to the compensation voltage under control of the first voltage signal and the data signal, and transmit a compensated data signal to the first node;

the compensation module comprises a first transistor, a second transistor, a third transistor, a fourth transistor, a fifth transistor, and a sixth transistor;

a gate electrode of the first transistor is connected to the data signal, a source electrode of the first transistor is connected to the data signal, and a drain electrode of the first transistor is connected to the third transistor;

a gate electrode of the second transistor is connected to the first voltage signal, a source electrode of the second transistor is connected to the first voltage signal, and a drain electrode of the second transistor is electrically connected to a fourth node;

a gate electrode of the third transistor is electrically connected to the fourth node, a source electrode of the third transistor is connected to the drain electrode of the first transistor, and a drain electrode of the third transistor is electrically connected to a fifth node;

a gate electrode of the fourth transistor is connected to the first power supply signal, a source electrode of the fourth transistor is connected to the scanning signal, and a drain electrode of the fourth transistor is electrically connected to the fifth node;

a gate electrode of the fifth transistor is connected to the first clock signal, a source electrode of the fifth transistor is electrically connected to the fourth node, and a drain electrode of the fifth transistor is electrically connected to a sixth node;

a gate electrode of the sixth transistor is connected to the second clock signal, a source electrode of the sixth transistor is electrically connected to the fourth node, and a drain electrode of the sixth transistor is electrically connected to the sixth node; and the receiving module comprises a seventh transistor; a gate electrode of the seventh transistor is electrically connected to the first node, a source electrode of the seventh transistor is electrically connected to the second node, and a drain electrode of the seventh transistor is connected to the data signal.

In the pixel driving circuit provided by an embodiment of the present disclosure, the light-emitting module comprises an eighth transistor, a storage capacitor, and a light-emitting device;

a gate electrode of the eighth transistor is electrically connected to the second node, a source electrode of the eighth transistor is connected to a second power supply signal, and a drain electrode of the eighth transistor is electrically connected to the third node;

a first terminal of the storage capacitor is electrically connected to the second node, and a second terminal of the storage capacitor is electrically connected to the third node; and a cathode of the light-emitting device is electrically connected to the third node, and an anode of the light-emitting device is electrically connected to a third power supply signal.

In the pixel driving circuit provided by an embodiment of the present disclosure, the detection module comprises a ninth transistor and a detection unit;

a gate electrode of the ninth transistor is electrically connected to the first node, a source electrode of the ninth transistor is connected to the detection unit, and a drain electrode of the ninth transistor is electrically connected to the third node; and a terminal of the detection unit is connected to the source electrode of the ninth transistor, another terminal of the detection unit is connected to the regulated signal, and the detection unit detects the actual voltage of the light-emitting module and compares the actual voltage to the predetermined voltage under control of the regulated signal to generate the compensation voltage of the light-emitting module.

In the pixel driving circuit provided by an embodiment of the present disclosure, the compensation module generates a compensation voltage of the eighth transistor according to an actual voltage of the eighth transistor, then generates a compensation signal according to the compensation voltage of the eighth transistor, and transmits the compensation signal to the seventh transistor.

In the pixel driving circuit provided by an embodiment of the present disclosure, the first transistor, the second transistor, the third transistor, the fourth transistor, the fifth transistor, the sixth transistor, the seventh transistor, the eighth transistor, and the ninth transistor are n-type transistors.

In the pixel driving circuit provided by an embodiment of the present disclosure, a driving time sequence of the pixel driving circuit comprises:

a detection phase, detecting the actual voltage of the light-emitting module and comparing the actual voltage to the predetermined voltage to generate the compensation voltage of the light-emitting module;

a compensation phase, compensating the data signal according to the compensation voltage; and a light-emitting phase, the pixel driving circuit generating a drive current and providing the drive current to the light-emitting device to drive the light-emitting device to emit light and enable displaying.

In the pixel driving circuit provided by an embodiment of the present disclosure, in the detection phase, the first voltage signal is a high electric potential, the second voltage signal is a low electric potential, the first clock signal and the second clock signal are alternatively a high electric potential and a low electric potential, the first power supply signal is a high electric potential, the scanning signal is transmitted to the first node, the light-emitting device emits light under control of the electric potential of the first node, and the detection unit detects an electric potential of the second node in order to detect the actual voltage of the light-emitting module and calculate a difference between the actual voltage and the predetermined voltage to obtain the compensation voltage of the light-emitting module;

in the compensation phase, the first voltage signal is a high electric potential, the second voltage signal is a low electric potential, the first clock signal is a low electric potential, the second clock signal is a low electric potential, the first power supply signal is a low electric potential, and the first transistor and the third transistor compensate the data signal according to the compensation voltage; and in the light-emitting phase, the first voltage signal is a high electric potential, the second voltage signal is a low electric potential, the first clock signal is a low electric potential, the second clock signal is a low electric potential, the first power supply signal is a low electric potential, the first node maintains an electric potential of the compensated data signal, and the second power supply signal is transmitted to the light-emitting device.

At a second aspect, an embodiment of the present disclosure provides a pixel driving circuit, which comprises a compensation module, a receiving module, a light-emitting module, and a detection module; wherein the receiving module and the detection module are connected to the light-emitting module, and the receiving module and the detection module are connected to the compensation module;

the compensation module receives a first voltage signal, a second voltage signal, a first clock signal, a second clock signal, a data signal, a scanning signal, and a first power supply signal, the compensation module is used to transmit the data signal to a first node under control of the first power supply signal; the compensation module receives a first voltage signal, a second voltage signal, a first clock signal, a second clock signal, a data signal, a scanning signal, and a first power supply signal, the compensation module is used to transmit the data signal to a first node under control of the first power supply signal;

the receiving module is electrically connected to a second node and the first node, and the receiving module is used to transmit the data signal to the second node under control of an electric potential of the first node; and the detection module receives a regulated signal, the detection module is used to transmit the regulated signal to a third node under control of the electric potential of the first node to stabilize an electric potential of the third node, and the detection module is also used to detect an actual voltage of the light-emitting module and to compare the actual voltage to a predetermined voltage in order to generate a compensation voltage of the light-emitting module;

wherein the compensation module is also used to compensate the data signal according to the compensation voltage under control of the first voltage signal and the data signal, and transmit a compensated data signal to the first node.

In the pixel driving circuit provided by an embodiment of the present disclosure, the compensation module comprises a first transistor, a second transistor, a third transistor, a fourth transistor, a fifth transistor, and a sixth transistor;

a gate electrode of the first transistor is connected to the data signal, a source electrode of the first transistor is connected to the data signal, and a drain electrode of the first transistor is connected to the third transistor;

a gate electrode of the second transistor is connected to the first voltage signal, a source electrode of the second transistor is connected to the first voltage signal, and a drain electrode of the second transistor is electrically connected to a fourth node;

a gate electrode of the third transistor is electrically connected to the fourth node, a source electrode of the third transistor is connected to the drain electrode of the first transistor, and a drain electrode of the third transistor is electrically connected to a fifth node;

a gate electrode of the fourth transistor is connected to the first power supply signal, a source electrode of the fourth transistor is connected to the scanning signal, and a drain electrode of the fourth transistor is electrically connected to the fifth node;

a gate electrode of the fifth transistor is connected to the first clock signal, a source electrode of the fifth transistor is electrically connected to the fourth node, and a drain electrode of the fifth transistor is electrically connected to a sixth node; and a gate electrode of the sixth transistor is connected to the second clock signal, a source electrode of the sixth transistor is electrically connected to the fourth node, and a drain electrode of the sixth transistor is electrically connected to the sixth node.

In the pixel driving circuit provided by an embodiment of the present disclosure, the receiving module comprises a seventh transistor; and the receiving module comprises a seventh transistor; a gate electrode of the seventh transistor is electrically connected to the first node, a source electrode of the seventh transistor is electrically connected to the second node, and a drain electrode of the seventh transistor is connected to the data signal.

In the pixel driving circuit provided by an embodiment of the present disclosure, the light-emitting module comprises an eighth transistor, a storage capacitor, and a light-emitting device;

a gate electrode of the eighth transistor is electrically connected to the second node, a source electrode of the eighth transistor is connected to a second power supply signal, and a drain electrode of the eighth transistor is electrically connected to the third node;

a first terminal of the storage capacitor is electrically connected to the second node, and a second terminal of the storage capacitor is electrically connected to the third node; and a cathode of the light-emitting device is electrically connected to the third node, and an anode of the light-emitting device is electrically connected to a third power supply signal.

In the pixel driving circuit provided by an embodiment of the present disclosure, the detection module comprises a ninth transistor and a detection unit;

a gate electrode of the ninth transistor is electrically connected to the first node, a source electrode of the ninth transistor is connected to the detection unit, and a drain electrode of the ninth transistor is electrically connected to the third node; and a terminal of the detection unit is connected to the source electrode of the ninth transistor, another terminal of the detection unit is connected to the regulated signal, and the detection unit detects the actual voltage of the light-emitting module and compares the actual voltage to the predetermined voltage under control of the regulated signal to generate the compensation voltage of the light-emitting module.

In the pixel driving circuit provided by an embodiment of the present disclosure, the compensation module generates a compensation voltage of the eighth transistor according to an actual voltage of the eighth transistor, then generates a compensation signal according to the compensation voltage of the eighth transistor, and transmits the compensation signal to the seventh transistor.

In the pixel driving circuit provided by an embodiment of the present disclosure, the first transistor, the second transistor, the third transistor, the fourth transistor, the fifth transistor, the sixth transistor, the seventh transistor, the eighth transistor, and the ninth transistor are n-type transistors.

In the pixel driving circuit provided by an embodiment of the present disclosure, a driving time sequence of the pixel driving circuit comprises:

a detection phase, detecting the actual voltage of the light-emitting module and comparing the actual voltage to the predetermined voltage to generate the compensation voltage of the light-emitting module;

a compensation phase, compensating the data signal according to the compensation voltage; and a light-emitting phase, the pixel driving circuit generating a drive current and providing the drive current to the light-emitting device to drive the light-emitting device to emit light and enable displaying.

In the pixel driving circuit provided by an embodiment of the present disclosure, in the detection phase, the first voltage signal is a high electric potential, the second voltage signal is a low electric potential, the first clock signal and the second clock signal are alternatively a high electric potential and a low electric potential, the first power supply signal is a high electric potential, the scanning signal is transmitted to the first node, the light-emitting device emits light under control of the electric potential of the first node, and the detection unit detects an electric potential of the second node in order to detect the actual voltage of the light-emitting module and calculate a difference between the actual voltage and the predetermined voltage to obtain the compensation voltage of the light-emitting module;

in the compensation phase, the first voltage signal is a high electric potential, the second voltage signal is a low electric potential, the first clock signal is a low electric potential, the second clock signal is a low electric potential, the first power supply signal is a low electric potential, and the first transistor and the third transistor compensate the data signal according to the compensation voltage; and in the light-emitting phase, the first voltage signal is a high electric potential, the second voltage signal is a low electric potential, the first clock signal is a low electric potential, the second clock signal is a low electric potential, the first power supply signal is a low electric potential, the first node maintains an electric potential of the compensated data signal, and the second power supply signal is transmitted to the light-emitting device.

In a third aspect, an embodiment of the present disclosure provides a display panel, which comprises a pixel driving circuit, wherein the pixel driving circuit comprises a compensation module, a receiving module, a light-emitting module, and a detection module; wherein the receiving module and the detection module are connected to the light-emitting module, and the receiving module and the detection module are connected to the compensation module;

the compensation module receives a first voltage signal, a second voltage signal, a first clock signal, a second clock signal, a data signal, a scanning signal, and a first power supply signal, the compensation module is used to transmit the data signal to a first node under control of the first power supply signal; the compensation module receives a first voltage signal, a second voltage signal, a first clock signal, a second clock signal, a data signal, a scanning signal, and a first power supply signal, the compensation module is used to transmit the data signal to a first node under control of the first power supply signal;

the receiving module is electrically connected to a second node and the first node, and the receiving module is used to transmit the data signal to the second node under control of an electric potential of the first node; and the detection module receives a regulated signal, the detection module is used to transmit the regulated signal to a third node under control of the electric potential of the first node to stabilize an electric potential of the third node, and the detection module is also used to detect an actual voltage of the light-emitting module and to compare the actual voltage to a predetermined voltage in order to generate a compensation voltage of the light-emitting module;

wherein the compensation module is also used to compensate the data signal according to the compensation voltage under control of the first voltage signal and the data signal, and transmit a compensated data signal to the first node.

The beneficial effect: the present disclosure uses a structure of 9T1C in a pixel driving circuit, detects actual voltages of driving transistors in each pixel, and determines threshold voltages of the driving transistors in each pixel according to the actual voltages, thereby effectively compensating the driving transistors in each pixel to achieve the objective of improving luminous uniformity of light-emitting devices and display quality.

DESCRIPTION OF DRAWINGS

The accompanying figures to be used in the description of embodiments of the present disclosure or prior art will be described in brief to more clearly illustrate the technical solutions of the embodiments or the prior art. The accompanying figures described below are only part of the embodiments of the present disclosure, from which figures those skilled in the art can derive further figures without making any inventive efforts.

DETAILED DESCRIPTION OF PREFERRED EMBODIMENTS

The embodiments of the present disclosure are described in detail hereinafter. Examples of the described embodiments are given in the accompanying drawings. The specific embodiments described with reference to the attached drawings are all exemplary and are intended to illustrate and interpret the present disclosure. Based on the embodiments in the present disclosure, all other embodiments obtained by those skilled in the art without creative efforts are within the scope of the present disclosure.

The transistors used in all embodiments of the present disclosure may be thin film transistors, field effect transistors, or other devices having the same characteristics. Because source and drain electrodes of the transistors used here are symmetrical, the source and drain electrodes of the transistors are interchangeable. In an embodiment of the present disclosure, in order to distinguish the two electrodes other than the gate electrode in a transistor, one of them is called a source electrode and the other is called a drain electrode. According to the form in the figure, a middle terminal of a switching transistor is a gate electrode, a signal input terminal is a source electrode, and an output terminal is a drain electrode. In addition, the transistors used in the embodiments of the present disclosure may comprise a p-type transistor and/or an n-type transistor. The p-type transistor is turned on when the gate electrode is at a low level, and is turned off when the gate electrode is at a high level. The n-type transistor is turned on when the gate electrode is at a high level, and is turned off when the gate electrode is at a low level.

Figure 1:
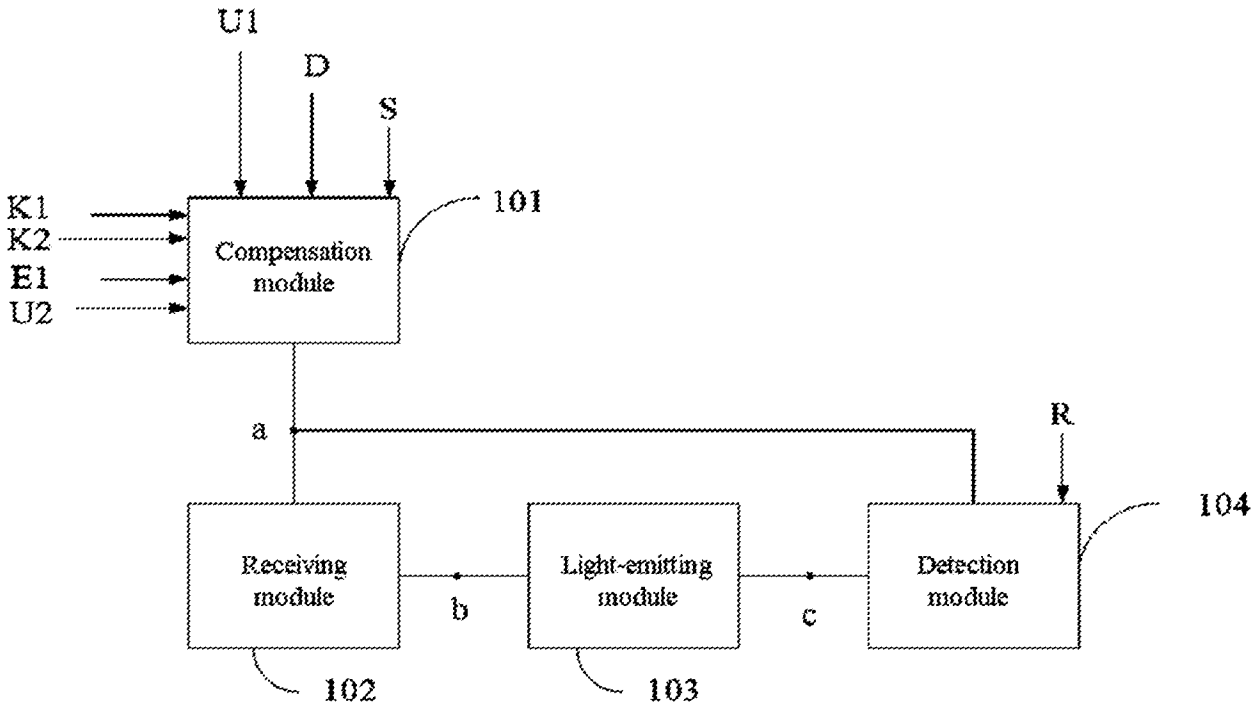
FIG. 1 is a schematic structural diagram of a pixel driving circuit according to an embodiment of the present disclosure.

Referring to FIG. 1, FIG. 1 is a schematic structural diagram of a pixel driving circuit according to an embodiment of the present disclosure. As shown in FIG. 1, the pixel driving circuit provided in the embodiment of the present disclosure comprises a compensation module 101, a receiving module 102, a light-emitting module 103, and a detection module 104. The receiving module 102 and the detection module 104 are connected to the light-emitting module 103, and the receiving module 102 and the detection module 104 are connected to the compensation module 101.

Wherein, the compensation module 101 receives a first voltage signal U1, a second voltage signal U2, a first clock signal K1, a second clock signal K2, a data signal D, a scanning signal S, and a first power supply signal E1, the compensation module 101 is used to transmit the data signal D to a first node a under control of the first power supply signal E1. The receiving module 102 is electrically connected to the second node b and the first node a. The receiving module 102 is used to transmit the data signal D to the second node b under control of an electric potential of the first node a. The detection module 104 receives a regulated signal R, the detection module 104 is used to transmit the regulated signal R to a third node c under control of the electric potential of the first node a to stabilize an electric potential of the third node c, and the detection module 104 is also used to detect an actual voltage of the light-emitting module 103, and to compare the actual voltage to a predetermined voltage in order to generate a compensation voltage of the light-emitting module 103. The compensation module 101 is also used to compensate the data signal D according to the compensation voltage under control of the first voltage signal E1 and the data signal D, and transmit the compensated data signal D to the first node a.

Figure 2:
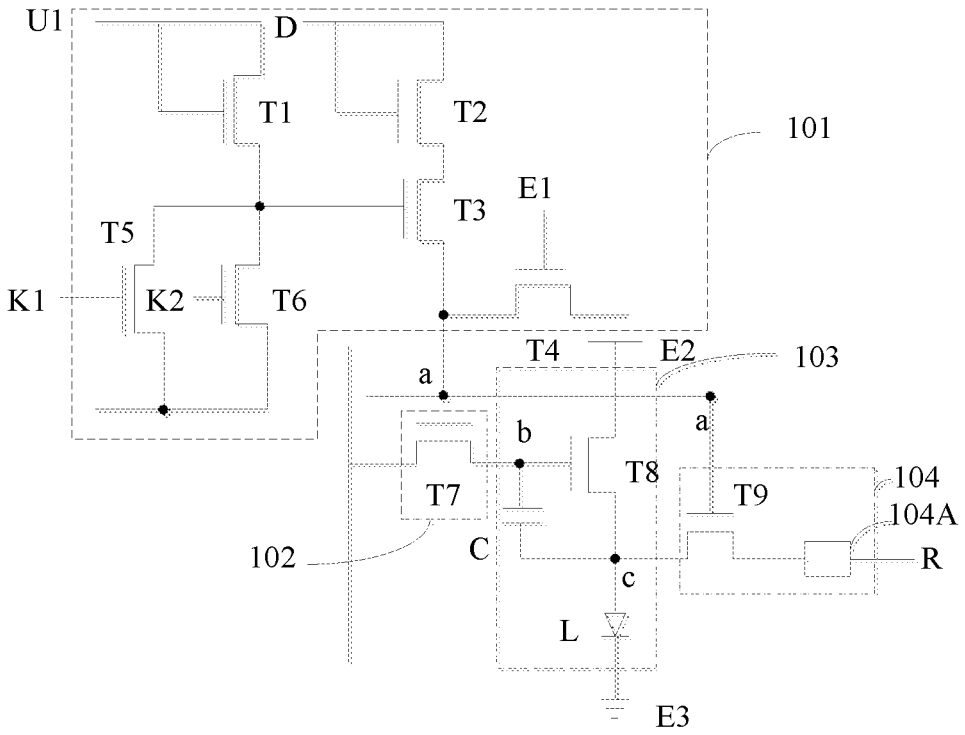
FIG. 2 is a schematic circuit diagram of a pixel driving circuit according to an embodiment of the present disclosure.

Specifically, referring to FIG. 2, FIG. 2 is a schematic circuit diagram of a pixel driving circuit according to an embodiment of the present disclosure.

The compensation module 101 comprises a first transistor T1, a second transistor T2, a third transistor T3, a fourth transistor T4, a fifth transistor T5, and a sixth transistor T6.

Wherein, a gate electrode of the first transistor T1 is connected to the data signal D, a source electrode of the first transistor T1 is connected to the data signal D, and a drain electrode of the first transistor T1 is connected to the third transistor T3. A gate electrode of the second transistor T2 is connected to the first voltage signal U1, a source electrode of the second transistor T2 is connected to the first voltage signal U1, and a drain electrode of the second transistor T2 is electrically connected to a fourth node d. A gate electrode of the third transistor T3 is electrically connected to the fourth node d, a source electrode of the third transistor T3 is connected to the drain electrode of the first transistor T1, and a drain electrode of the third transistor T3 is electrically connected to a fifth node e. A gate electrode of the fourth transistor T4 is connected to the first power supply signal E1, a source electrode of the fourth transistor T4 is connected to the scanning signal S, and a drain electrode of the fourth transistor T4 is electrically connected to the fifth node e. A gate electrode of the fifth transistor T5 is connected to the first clock signal K1, a source electrode of the fifth transistor T5 is electrically connected to the fourth node d, and a drain electrode of the fifth transistor T5 is electrically connected to a sixth node f. A gate electrode of the sixth transistor T6 is connected to the second clock signal K2, a source electrode of the sixth transistor T6 is electrically connected to the fourth node d, and a drain electrode of the sixth transistor T6 is electrically connected to the sixth node f.

The receiving module 102 comprises a seventh transistor T7. A gate electrode of the seventh transistor T7 is electrically connected to the first node a, a source electrode of the seventh transistor T7 is electrically connected to the second node b, and a drain electrode of the seventh transistor T7 is connected to the data signal D.

The light-emitting module 103 comprises an eighth transistor T8, a storage capacitor C, and a light-emitting device L. A gate electrode of the eighth transistor T8 is electrically connected to the second node b, a source electrode of the eighth transistor T8 is connected to a second power supply signal U2, and a drain electrode of the eighth transistor T8 is electrically connected to the third node c. A first terminal of the storage capacitor C is electrically connected to the second node b, and a second terminal of the storage capacitor C is electrically connected to the third node c. A cathode of the light-emitting device L is electrically connected to the third node c, and an anode of the light-emitting device L is electrically connected to a third power supply signal E3. It should be noted that in the present disclosure, the eighth transistor T8 is a driving transistor.

The detection module 104 comprises a ninth transistor T9 and a detection unit 104A. A gate electrode of the ninth transistor T9 is electrically connected to the first node a, a source electrode of the ninth transistor T9 is connected to the detection unit 104A, and a drain electrode of the ninth transistor T9 is electrically connected to the third node c. A terminal of the detection unit 104A is connected to the source electrode of the ninth transistor T9, another terminal of the detection unit 104A is connected to the regulated signal R, and the detection unit 104A detects the actual voltage of the light-emitting module 103, and compares the actual voltage to the predetermined voltage under control of the regulated signal R to generate the compensation voltage of the light-emitting module 103.

It should be noted that the compensation module 101 generates a compensation voltage of the eighth transistor T8 according to an actual voltage of the eighth transistor T8, then generates a compensation signal according to the compensation voltage of the eighth transistor T8, and transmits the compensation signal to the seventh transistor T7.

In some embodiments of the present disclosure, the first transistor T1, the second transistor T2, the third transistor T3, the fourth transistor T4, the fifth transistor T5, the sixth transistor T6, the seventh transistor T7, the eighth transistor T8, and the ninth transistor T9 are n-type transistors. The transistors of the pixel driving circuit in the embodiment of the present disclosure are the same type transistors that prevents differences in different types of transistors to influence the pixel driving circuit.

The embodiment of the present disclosure detects actual voltages of driving transistors in each pixel, and determines threshold voltages of the driving transistors in each pixel according to the actual voltages, thereby effectively compensating the driving transistors in each pixel to achieve the objective of improving luminous uniformity of light-emitting devices and display quality.

Figure 3:
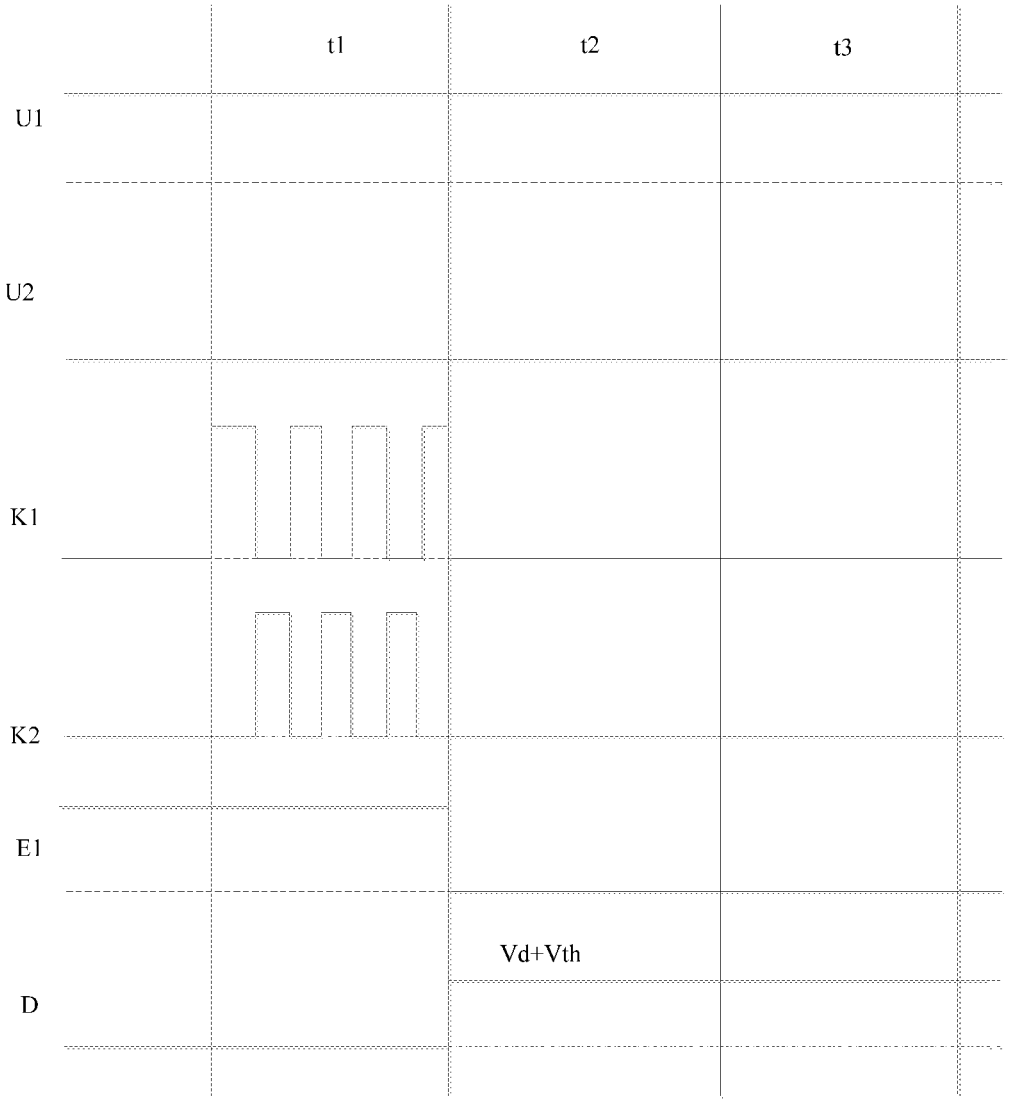
FIG. 3 is a timing diagram of drive signals of a pixel driving circuit according to an embodiment of the present disclosure.

Referring to FIG. 3, FIG. 3 is a timing diagram of drive signals of a pixel driving circuit according to an embodiment of the present disclosure. A driving time sequence of the pixel driving circuit comprises:

a detection phase t1, detecting the actual voltage of the light-emitting module 101 and comparing the actual voltage to the predetermined voltage to generate the compensation voltage of the light-emitting module 103.

A compensation phase t2, compensating the data signal D according to the compensation voltage.

A light-emitting phase t3, the pixel driving circuit generating a drive current and providing the drive current to the light-emitting device L to drive the light-emitting device L to emit light and enable the displaying.

Specifically, in the detection phase t1, the first voltage signal U1 is a high electric potential, the second voltage signal U2 is a low electric potential, the first clock signal K1 and the second clock signal K2 are alternatively a high electric potential and a low electric potential, the first power supply signal E1 is a high electric potential, the first transistor T1 is turned on, the second transistor T2 is turned on, the third transistor T3 is turned off, the fourth transistor T4 is turned on, and the fifth transistor T5 and the sixth transistor T6 are alternatively turned on. It should be noted that in the present disclosure, because sizes of the fifth transistor T5 and the sixth transistor T6 are greater than a size of the second transistor T2, the first clock signal K1 and the second clock signal K2 are alternatively a high electric potential and a low electric potential. The second voltage signal U2 is transmitted to the fourth node d through the fifth transistor T5 or the sixth transistor T6, and at the time, an electric potential of the fourth node d is a corresponding electric potential of the second voltage signal U2. That is, the fourth node d is at a low electric potential, so the scanning signal S is transmitted to the first node a through the fourth transistor T4, the light-emitting device L emits light under control of the electric potential of the first node a, and the detection unit 104A detects an electric potential of the second node b in order to detect the actual voltage of the light-emitting module 103 and calculate a difference between the actual voltage and the predetermined voltage to obtain the compensation voltage Vth of the light-emitting module. In addition, the electric potential of the data signal D also could be transmitted to the ninth transistor T9 through the first node a to stabilize the electric potential of the third node c.

In the compensation phase t2, the first voltage signal U1 is a high electric potential, the second voltage signal U2 is a low electric potential, the first clock signal K1 is a low electric potential, the second clock signal K2 is a low electric potential, the first power supply signal E1 is a low electric potential, the first transistor T1 is turned on, the second transistor T2 is turned on, the third transistor T3 is turned on, the fourth transistor T4 is turned off, the fifth transistor T5 is turned off, the sixth transistor T6 is turned off, the seventh transistor T7 is turned on, the eighth transistor T8 is turned on, the ninth transistor T9 is turned on, and the compensated data signal D is transmitted to the third node c through the first node a and the ninth transistor T9 to make the electric potential of the third node c become Vd+Vth.

In the light-emitting phase t3, the first voltage signal U1 is a high electric potential, the second voltage signal U2 is a low electric potential, the first clock signal K1 is a low electric potential, the second clock signal K2 is a low electric potential, the first power supply signal E is a low electric potential, the first transistor T1 is turned on, the second transistor T2 is turned on, the third transistor T3 is turned on, the fourth transistor T4 is turned off, the fifth transistor T5 is turned off, the sixth transistor T6 is turned off, the seventh transistor T7 is turned on, the eighth transistor T8 is turned on, the ninth transistor T9 is turned on, the first node a maintains the electric potential of the compensated data signal D, and the second power supply signal E2 is transmitted to the light-emitting device L through the eighth transistor T8 to make the light-emitting device L emit light.

The pixel driving circuit and the display panel provided by the present disclosure detect the actual voltage of the eighth transistor T8 in each pixel, and determine the threshold voltage of the eighth transistor T8 in each pixel according to the actual voltage, thereby effectively compensating the eighth transistor T8 in each pixel to achieve the objective of improving luminous uniformity of light-emitting devices and display quality.

The present disclosure has been described with a preferred embodiment thereof. The preferred embodiment is not intended to limit the present disclosure, and it is understood that many changes and modifications to the described embodiment can be carried out without departing from the scope and the spirit of the disclosure.

What is claimed is:

1. A pixel driving circuit, comprising a compensation module, a receiving module, a light-emitting module, and a detection module; wherein the receiving module and the detection module are connected to the light-emitting module, and the receiving module and the detection module are connected to the compensation module;

the compensation module receives a first voltage signal, a second voltage signal, a first clock signal, a second clock signal, a data signal, a scanning signal, and a first power supply signal, the compensation module is used to transmit the data signal to a first node under control of the first power supply signal;

the receiving module is electrically connected to a second node and the first node, and the receiving module is used to transmit the data signal to the second node under control of an electric potential of the first node; and the detection module receives a regulated signal, the detection module is used to transmit the regulated signal to a third node under control of the electric potential of the first node to stabilize an electric potential of the third node, and the detection module is also used to detect an actual voltage of the light-emitting module, and to compare the actual voltage to a predetermined voltage in order to generate a compensation voltage of the light-emitting module;

wherein the compensation module is also used to compensate the data signal according to the compensation voltage under control of the first voltage signal and the data signal, and transmit a compensated data signal to the first node;

the compensation module comprises a first transistor, a second transistor, a third transistor, a fourth transistor, a fifth transistor, and a sixth transistor;

a gate electrode of the first transistor is connected to the data signal, a source electrode of the first transistor is connected to the data signal, and a drain electrode of the first transistor is connected to the third transistor;

a gate electrode of the second transistor is connected to the first voltage signal, a source electrode of the second transistor is connected to the first voltage signal, and a drain electrode of the second transistor is electrically connected to a fourth node;

a gate electrode of the third transistor is electrically connected to the fourth node, a source electrode of the third transistor is connected to the drain electrode of the first transistor, and a drain electrode of the third transistor is electrically connected to a fifth node;

a gate electrode of the fourth transistor is connected to the first power supply signal, a source electrode of the fourth transistor is connected to the scanning signal, and a drain electrode of the fourth transistor is electrically connected to the fifth node;

a gate electrode of the fifth transistor is connected to the first clock signal, a source electrode of the fifth transistor is electrically connected to the fourth node, and a drain electrode of the fifth transistor is electrically connected to a sixth node; and a gate electrode of the sixth transistor is connected to the second clock signal, a source electrode of the sixth transistor is electrically connected to the fourth node, and a drain electrode of the sixth transistor is electrically connected to the sixth node.

2. The pixel driving circuit according to claim 1, wherein the receiving module comprises a seventh transistor; and a gate electrode of the seventh transistor is electrically connected to the first node, a source electrode of the seventh transistor is electrically connected to the second node, and a drain electrode of the seventh transistor is connected to the data signal.

3. The pixel driving circuit according to claim 2, wherein the light-emitting module comprises an eighth transistor, a storage capacitor, and a light-emitting device;

a gate electrode of the eighth transistor is electrically connected to the second node, a source electrode of the eighth transistor is connected to a second power supply signal, and a drain electrode of the eighth transistor is electrically connected to the third node;

a first terminal of the storage capacitor is electrically connected to the second node, and a second terminal of the storage capacitor is electrically connected to the third node; and a cathode of the light-emitting device is electrically connected to the third node, and an anode of the light-emitting device is electrically connected to a third power supply signal.

4. The pixel driving circuit according to claim 3, wherein the detection module comprises a ninth transistor and a detection unit;

a gate electrode of the ninth transistor is electrically connected to the first node, a source electrode of the ninth transistor is connected to the detection unit, and a drain electrode of the ninth transistor is electrically connected to the third node; and a terminal of the detection unit is connected to the source electrode of the ninth transistor, another terminal of the detection unit is connected to the regulated signal, and the detection unit detects the actual voltage of the light-emitting module and compares the actual voltage to the predetermined voltage under control of the regulated signal to generate the compensation voltage of the light-emitting module.

5. The pixel driving circuit according to claim 4, wherein the compensation module generates a compensation voltage of the eighth transistor according to an actual voltage of the eighth transistor, then generates a compensation signal according to the compensation voltage of the eighth transistor, and transmits the compensation signal to the seventh transistor.

6. The pixel driving circuit according to claim 5, wherein the first transistor, the second transistor, the third transistor, the fourth transistor, the fifth transistor, the sixth transistor, the seventh transistor, the eighth transistor, and the ninth transistor are n-type transistors.

7. The pixel driving circuit according to claim 6, wherein a driving time sequence of the pixel driving circuit comprises:

a detection phase, detecting the actual voltage of the light-emitting module and comparing the actual voltage to the predetermined voltage to generate the compensation voltage of the light-emitting module;

a compensation phase, compensating the data signal according to the compensation voltage; and a light-emitting phase, the pixel driving circuit generating a drive current and providing the drive current to the light-emitting device to drive the light-emitting device to emit light and enable displaying.

8. The pixel driving circuit according to claim 7, wherein in the detection phase, the first voltage signal is a high electric potential, the second voltage signal is a low electric potential, the first clock signal and the second clock signal are alternatively a high electric potential and a low electric potential, the first power supply signal is a high electric potential, the scanning signal is transmitted to the first node, the light-emitting device emits light under control of the electric potential of the first node, and the detection unit detects an electric potential of the second node in order to detect the actual voltage of the light-emitting module and calculate a difference between the actual voltage and the predetermined voltage to obtain the compensation voltage of the light-emitting module;

in the compensation phase, the first voltage signal is a high electric potential, the second voltage signal is a low electric potential, the first clock signal is a low electric potential, the second clock signal is a low electric potential, the first power supply signal is a low electric potential, and the first transistor and the third transistor compensate the data signal according to the compensation voltage; and in the light-emitting phase, the first voltage signal is a high electric potential, the second voltage signal is a low electric potential, the first clock signal is a low electric potential, the second clock signal is a low electric potential, the first power supply signal is a low electric potential, the first node maintains an electric potential of the compensated data signal, and the second power supply signal is transmitted to the light-emitting device.

9. A display panel, comprising a pixel driving circuit, wherein the pixel driving circuit comprises a compensation module, a receiving module, a light-emitting module, and a detection module; wherein the receiving module and the detection module are connected to the light-emitting module, and the receiving module and the detection module are connected to the compensation module;

the compensation module receives a first voltage signal, a second voltage signal, a first clock signal, a second clock signal, a data signal, a scanning signal, and a first power supply signal, the compensation module is used to transmit the data signal to a first node under control of the first power supply signal; the compensation module receives a first voltage signal, a second voltage signal, a first clock signal, the receiving module is electrically connected to a second node and the first node, and the receiving module is used to transmit the data signal to the second node under control of an electric potential of the first node; and the detection module receives a regulated signal, the detection module is used to transmit the regulated signal to a third node under control of the electric potential of the first node to stabilize an electric potential of the third node, and the detection module is also used to detect an actual voltage of the light-emitting module, and to compare the actual voltage to a predetermined voltage in order to generate a compensation voltage of the light-emitting module;

wherein the compensation module is also used to compensate the data signal according to the compensation voltage under control of the first voltage signal and the data signal, and transmit a compensated data signal to the first node;

the compensation module comprises a first transistor, a second transistor, a third transistor, a fourth transistor, a fifth transistor, and a sixth transistor;

a gate electrode of the first transistor is connected to the data signal, a source electrode of the first transistor is connected to the data signal, and a drain electrode of the first transistor is connected to the third transistor;

a gate electrode of the second transistor is connected to the first voltage signal, a source electrode of the second transistor is connected to the first voltage signal, and a drain electrode of the second transistor is electrically connected to a fourth node;

a gate electrode of the third transistor is electrically connected to the fourth node, a source electrode of the third transistor is connected to the drain electrode of the first transistor, and a drain electrode of the third transistor is electrically connected to a fifth node;

a gate electrode of the fourth transistor is connected to the first power supply signal, a source electrode of the fourth transistor is connected to the scanning signal, and a drain electrode of the fourth transistor is electrically connected to the fifth node;

a gate electrode of the fifth transistor is connected to the first clock signal, a source electrode of the fifth transistor is electrically connected to the fourth node, and a drain electrode of the fifth transistor is electrically connected to a sixth node; and a gate electrode of the sixth transistor is connected to the second clock signal, a source electrode of the sixth transistor is electrically connected to the fourth node, and a drain electrode of the sixth transistor is electrically connected to the sixth node.

* * * * *